US011754308B1

(12) United States Patent
Sullins

(10) Patent No.: US 11,754,308 B1
(45) Date of Patent: Sep. 12, 2023

(54) APPARATUS AND METHOD FOR FRESH AIR COOLING OF A RESIDENCE OR BUILDING UTILIZING A THERMOSTAT

(71) Applicant: Jason Sullins, Beaverton, OR (US)

(72) Inventor: Jason Sullins, Beaverton, OR (US)

( * ) Notice: Subject to any disclaimer, the term of this patent is extended or adjusted under 35 U.S.C. 154(b) by 0 days.

(21) Appl. No.: 17/895,355

(22) Filed: Aug. 25, 2022

(51) Int. Cl.

| | |
|---|---|
| ***F24F 11/67*** | (2018.01) |
| ***F24F 7/013*** | (2006.01) |
| ***F24F 11/52*** | (2018.01) |
| ***F24F 11/00*** | (2018.01) |
| ***F24F 11/64*** | (2018.01) |
| ***F24F 11/56*** | (2018.01) |
| *F24F 110/70* | (2018.01) |
| *F24F 110/12* | (2018.01) |
| *F24F 110/10* | (2018.01) |

(52) U.S. Cl.
CPC ..... *F24F 11/67* (2018.01); *F24F 7/013* (2013.01); *F24F 11/0001* (2013.01); *F24F 11/52* (2018.01); *F24F 11/56* (2018.01); *F24F 11/64* (2018.01); *F24F 2011/0002* (2013.01); *F24F 2110/10* (2018.01); *F24F 2110/12* (2018.01); *F24F 2110/70* (2018.01)

(58) Field of Classification Search
CPC ..... F24F 5/00; F24F 7/007; F24F 7/06; F24F 7/013; F24F 11/0001; F24F 2011/0002; F24F 11/52; F24F 11/56; F24F 11/62; F24F 11/64; F24F 11/65; F24F 11/67; F24F 11/72; F24F 11/80; F24F 12/00; F24F 2110/10; F24F 2110/12; F24F 2110/70; F24F 2110/72
See application file for complete search history.

(56) References Cited

U.S. PATENT DOCUMENTS 8,306,669 B1 * 11/2012 Smith ..... F24H 9/2085 700/202
8,543,244 B2 * 9/2013 Keeling ..... F24D 19/1066 700/297
10,520,205 B2 * 12/2019 Frank ..... F24F 11/30
(Continued)

FOREIGN PATENT DOCUMENTS

CN 1420311 A * 5/2003
CN 102762926 A * 10/2012 ..... F25D 16/00
(Continued)

*Primary Examiner* — Crystal J Barnes-Bullock
(74) *Attorney, Agent, or Firm* — Mohr Intellectual Property Law Solutions, PC

(57) ABSTRACT

A system and method for cooling a building using cool fresh outside air is disclosed. When the integrated thermostat is operating during a heating period, the integrated thermostat operates a remote air conditioning unit, such as a furnace, an HVAC unit, an electric baseboard heater, or a heat pump, to heat air provided to the building interior. When the integrated thermostat is operating during a cooling period or a fresh air cooling period, the integrated thermostat compares the indoor air temperature with the temperature of the outdoor fresh air. The integrated thermostat operates a remote fan, such as a whole-house exhaust fan, to draw the cooler fresh air into the building interior in response to the outdoor air temperature being less than the indoor air temperature and/or in response to the indoor temperature being greater than a fresh air cooling set point stored in the memory.

21 Claims, 6 Drawing Sheets

(56) References Cited

U.S. PATENT DOCUMENTS

| | | | | |
|---|---|---|---|---|
| 10,902,531 | B1 * | 1/2021 | Haynold | G01W 1/10 |
| 2012/0061068 | A1 | 3/2012 | Anderson | |
| 2015/0285524 | A1 | 10/2015 | Tempo | |
| 2018/0299150 | A1 | 10/2018 | Johnson | |
| 2021/0156582 | A1 | 5/2021 | Qc | |
| 2022/0205659 | A1 | 6/2022 | Ventamatic | |

FOREIGN PATENT DOCUMENTS

| | | | | | |
|---|---|---|---|---|---|
| CN | 111140976 | A | * | 5/2020 | |
| CN | 112944414 | A | * | 6/2021 | F24C 15/2021 |
| CN | 114508811 | A | * | 5/2022 | |
| CN | 114963582 | A | * | 8/2022 | |
| WO | WO-2018000988 | A1 | * | 1/2018 | F24F 11/00 |

* cited by examiner

APPARATUS AND METHOD FOR FRESH AIR COOLING OF A RESIDENCE OR BUILDING UTILIZING A THERMOSTAT

BACKGROUND OF THE INVENTION

Residence and building cooling during periods of warm weather is typically performed by an air conditioning (AC) unit or a heating, ventilation, and air conditioning (HVAC) system equipped with an AC unit, heat pump, or the like. The use of AC to cool buildings is one of the fastest growing uses of energy and can result in high costs to the residents of homes, tenants of a building, and/or the building owners (who are interchangeably referred to herein as residents).

In many climates, evening, nighttime, and early morning ambient temperatures may be relatively cool. Moving the cool ambient air into the residence or building may be a very desirable way to cool the residence rather than operating the AC system. However, there may be no practical way to efficiently transport cool ambient outside air into the residence (generically referred to herein as a building) or the building.

Often, the resident will open one or more windows to let the cool air into the residence or building. Fans may be employed to assist in the movement of cool air into the interior space of the residence or building. However, open windows may lead to safety and security issues. Furthermore, opening windows and turning on fans is tedious and is inaccurate in controlling indoor temperature, as it must be performed manually by the resident.

Accordingly, in the arts of residence and building air conditioning, and in particular the arts of thermostat controllers, there is a need in the arts for improved methods, apparatus, and systems for moving cool outside air into a building, such as a residence.

SUMMARY OF THE INVENTION

Embodiments of the integrated thermostat provide a system and method for cooling a building using cool fresh outside air. When the integrated thermostat is operating during a heating period, the integrated thermostat operates a remote air conditioning unit, such as a furnace, to heat air provided to the building interior. When the integrated thermostat is operating during a cooling period or a fresh air cooling period, the integrated thermostat compares the indoor air temperature with the temperature of the outdoor fresh air. The integrated thermostat operates a remote fan, such as a whole-house exhaust fan, to draw the cooler fresh air into the building interior in response to the outdoor air temperature being less than the indoor air temperature and/or in response to the indoor temperature being greater than a fresh air cooling set point stored in the memory.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
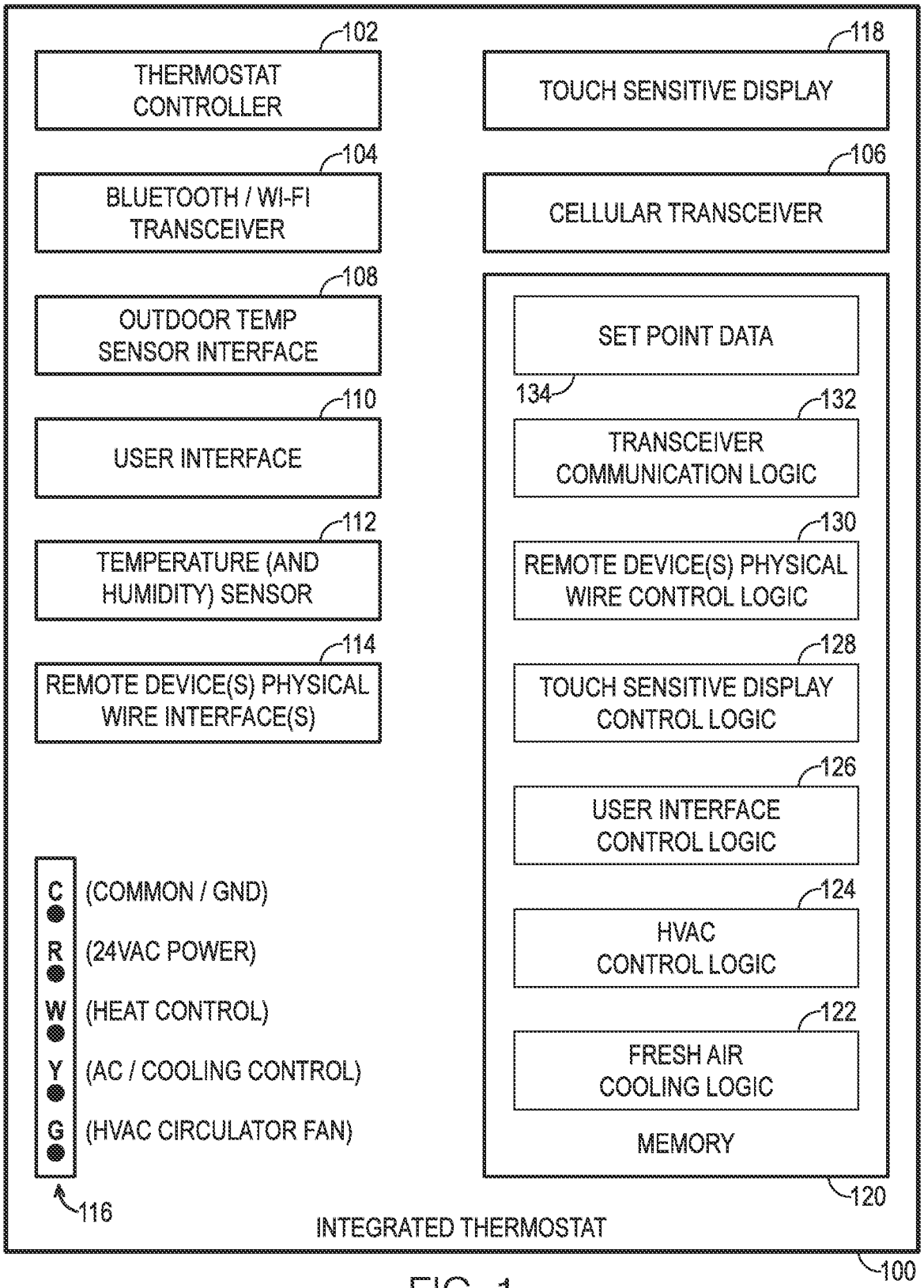
FIG. 1 is a block diagram of an integrated thermostat.

FIG. 1 is a block diagram of an integrated thermostat 100. Embodiments of the integrated thermostat 100 control multiple air conditioning units in a coordinated fashion. The term air conditioning, as defined herein, is a process to change one or more attributes or characteristics of air. Air conditioning can change air temperature (heating or cooling), filter air (remove particles, contaminants, bacteria, etc.), and/or change humidity level (dehumidify to reduce the humidity level and humidify to increase the humidity level).

Various types of air conditioning devices are available (interchangeably referred to herein as an air conditioning unit). A furnace unit may be used to heat air. An electric baseboard system and/or a radiant floor heating system may be used to heat air. An air conditioning (A/C) unit may be used to cool air. A heating ventilation and air conditioning (HVAC) unit is able to heat or cool air. A heat pump is also able to heat or cool air. A dehumidifier may be used to reduce the humidity level of air. A humidifier may be used to increase the humidity level of air. An evaporative cooler (swamp cooler) employs evaporative cooling to reduce air temperature and/or increase humidity level. A geothermal system may be used to cool or heat air using a current earth temperature. An electrostatic filter or fiber filter may be used to remove contaminants, particles, bacteria, etc., from air. Often, one or more of these air conditioning devices are combined into a multifunction air conditioning unit that performs specific air conditioning functions in accordance with control signals communicated from the integrated thermostat 100. All such air conditioning units are intended to be within the scope of this disclosure and to be protected by the accompanying claims.

For clarity, the phrase "air conditioning" as used herein denotes changing an attribute or characteristic of air. Accordingly, an air conditioning device (or unit) changes at least one attribute or characteristic of air. In contrast, the term "A/C" as used herein denotes the cooling of air. Accordingly, as defined herein, a type of air conditioning unit that at least cools air is an A/C device or unit. Examples of A/C devices include the cooling function of a heat pump or HVAC unit or an evaporative cooler.

In practice, embodiments of the integrated thermostat 100 are configured to fluidically transport air outside of the building (interchangeably referred to herein as "fresh air") into the interior of a building when the temperature of the outside fresh air is less than (preferably by at least some predefined temperature offset) the temperature of the air inside of the building (interchangeably referred to herein as "indoor air") during a cooling period and/or a fresh air cooling period. For example, if the building air is conditioned by an HVAC unit that has both air heating and air cooling capabilities, the integrated thermostat 100 may operate an air handling device, such as a whole-house exhaust fan, to bring (fluidically transport) the cooler fresh air into the building interior when the outside air temperature is less than the indoor air temperature.

When the temperature of the outside fresh air is equal to or greater than (preferably by at least some predefined temperature offset) the temperature of the interior air (indoor air) during a cooling period and/or a fresh air cooling period, then the integrated thermostat 100 may deactivate (turn off) the air handling device to end transport of the fresh air into the interior of the building. Concurrently, when a cooling unit is available, the integrated thermostat 100 may then initiate the operation of the A/C unit to generate cooled air that is transported or distributed into the interior of the building.

A whole house exhaust fan is an electrically powered fan that pulls fresh air through all of the windows and other non-airtight areas of the building, and sends the exhausted air into an attic of the building (which is then exhausted through an attic roof vent, side vent, gable vent, or the like). In some applications, the whole-house exhaust fan may transport exhausted air out of the building through a direct exhaust vent. (Powered attic ventilators, in contrast, simply push hot air out of the attic to facilitate the intake of colder air into the structure.)

For example, but not limited to, one centrally-located whole-house exhaust fan located in the ceiling of the top-most floor of a residence can change out the inside air in the residence three to six times per hour, depending on the size of the house and the whole-house exhaust fan's air volume movement capacity. The ceiling vent's louvers of the whole-house exhaust fan open and close in response to the fan's operation. When the ambient cool fresh air is fluidically transported into the interior of the building, then the warmer interior air is necessarily evacuated from (removed from) the interior of the building.

The disclosed systems and methods for an integrated thermostat 100 will become better understood through a review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations, however, for the sake of brevity, each and every contemplated variation is not individually described in the following detailed description.

Throughout the following detailed description, a variety of examples of systems and methods for using an integrated thermostat 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder but may have one or more deviations from a true cylinder.

"Comprising," "including," and "having" (and conjugations thereof) are used interchangeably to mean including but not necessarily limited to and are open-ended terms not intended to exclude additional elements or method steps not expressly recited.

Terms such as "first," "second," and "third" are used to distinguish or identify various members of a group, or the like, and are not intended to denote a serial, chronological, or numerical limitation.

"Coupled" means connected, either permanently or releasably, whether directly or indirectly through intervening components. "Secured to" means directly connected without intervening components.

"Communicatively coupled" means that an electronic device exchanges information with another electronic device, either wirelessly or with a wire-based connector, whether directly or indirectly, through a communication network. "Controllably coupled" means that an electronic device controls the operation of another electronic device.

A "heating period" is a period of time when the integrated thermostat 100 controls an operation of one or more air conditioning devices or units to be operated to generate heated air that is fluidically transported into one or more interior areas of the building. A "heating event" is an instance wherein the integrated thermostat 100 operates one or more air conditioning devices or units to generate the heated air. In a non-limiting integrated thermostat 100, a heating period may be defined by specified or predefined times (hours/minutes) of the day, that the resident of a building wishes to maintain a specified minimum indoor air temperature. Other embodiments of the integrated thermostat 100 may define heating periods in other manners without departing from the scope of this disclosure. For example, but not limited to, an alternative embodiment of the integrated thermostat 100 may be set during winter months to maintain a particular minimum set point temperature (a heating set point as defined herein to be a numeric value of a temperature specified in degrees Fahrenheit or Celsius). In such embodiments, the heating period spans twenty-four hours of the day and lasts until the resident resets their integrated thermostat 100. All such embodiments are intended to be protected by the accompanying claims.

During the heating period, if the current indoor air temperature during the heating period falls below (is less than) the specified minimum indoor air temperature set point during the heating period, then a heating event occurs such that the integrated thermostat 100 operates an air conditioning unit with heating capability to generate heated air that is transported into the interior of the building. That is, the integrated thermostat 100 controls an operation of an air conditioning unit to generate heated air. A temperature offset may be applied to the temperature set point to provide hysteresis and avoid control hunting. The heating period may be defined by a plurality of different periods of time, each associated with a unique minimum air temperature set point. Accordingly, heating events may occur when the current indoor air temperature decreases below an active minimum air temperature set point.

A "cooling period" is a period of time when the integrated thermostat 100 controls an operation of one or more air conditioning devices or units controlled by the integrated thermostat 100 to be operated to generate cooled air that is fluidically transported into one or more interior areas of the building. A "cooling event" is an instance wherein the integrated thermostat 100 operates one or more air conditioning devices or units to generate the cooled air. A cooling period may be defined by times (hours/minutes) of the day, that the resident of a building wishes to maintain a specified maximum indoor air temperature. Other embodiments of the integrated thermostat 100 may define cooling periods in other manners without departing from the scope of this disclosure. For example, but not limited to, an alternative embodiment of the integrated thermostat 100 may be set during the summer months to maintain a particular maximum set point temperature (a cooling set point as defined herein to be a numeric value of a temperature specified in degrees Fahrenheit or Celsius). In such embodiments, the cooling period spans twenty-four hours of the day and lasts until the resident resets their integrated thermostat 100. Accordingly, cooling events may occur when the current indoor air temperature increases above an active maximum air temperature set point. All such embodiments are intended to be protected by the accompanying claims.

During a cooling period, if the current indoor air temperature during the cooling period rises above (is greater than) the specified maximum indoor air temperature set point during the cooling period, then a cooling event occurs such that the integrated thermostat 100 may: (1) operate an air conditioning unit with cooling capability (A/C) to generate cooled air that is transported into the interior of the building, or (2) operate an air moving device or unit (such as, but not limited to, a whole-house exhaust fan) to transport outside fresh air into the interior of the building. That is, the integrated thermostat 100 controls an operation of an air conditioning unit to generate cool air and/or transport the outside cool fresh air. A temperature offset may be applied to the temperature set point to provide hysteresis and avoid control hunting. The cooling period may be defined by a plurality of different periods of time each associated with a unique maximum air temperature set point. Accordingly, cooling events may occur when the current indoor air temperature increases above an active maximum air temperature set point.

A "fresh air cooling period" is a period of time when one or more air conditioning devices or units are configured by the integrated thermostat 100 to be operated to bring outside fresh air into one or more interior areas of the building. A "fresh air cooling event" is an instance wherein the integrated thermostat 100 operates one or more air conditioning devices or units to bring the outside fresh air into the interior area of the building. That is, the integrated thermostat 100 controls an operation of an air conditioning unit to transport the outside cool fresh air. Preferably, a fresh air cooling period is defined by times (hours/minutes) of the day, that the resident of a building wishes to transport cool fresh air into the building when the outdoor air temperature (outdoor ambient air temperature) is less than the current indoor air temperature and/or is less than a fresh air cooling set point. For example, but not limited to, an alternative embodiment of the integrated thermostat 100 may be set during one or more selected months to maintain a particular maximum fresh air cooling set point temperature. In such embodiments, the fresh air cooling period spans twenty-four hours of the day and lasts until the resident resets their integrated thermostat 100. In some embodiments, the maximum indoor air temperature set point associated with a cooling period may be the same as the fresh air cooling set point.

In an example embodiment, if the current indoor air temperature during the fresh air cooling period rises above (is greater than) the specified fresh air cooling set point during the cooling period, then a fresh air cooling event occurs such that the integrated thermostat 100 may at least operate an air moving device or unit (such as, but not limited to, a whole-house exhaust fan) to transport outside fresh air into the interior of the building. Alternatively, or additionally, the integrated thermostat 100 may bring in the fresh air when the temperature of the outside fresh air is less than the current indoor air temperature. A temperature offset may be applied to the temperature set point to provide hysteresis and avoid control hunting. At times, the fresh air cooling period may overlap the times of a cooling period.

Some embodiments of the integrated thermostat 100 may employ a minimum temperature setting for the temperature of the indoor air such that, when a fresh air cooling event is underway and the current indoor temperature drops to the minimum temperature setting, the integrated thermostat 100 then ceases operation of the various controlled fans to stop bringing in the cool outside fresh air. For example, but not limited to, consider the hypothetical situation where the current indoor temperature is 80° F. and the temperature of the outdoor fresh air is 55° F. Assume that a comfortable 65° F. minimum temperature set point is in effect. During a fresh air cooling event, the 55° F. fresh air is transported into the interior areas of the building. The indoor air temperature will begin to decrease from its 80° F. temperature. When the indoor air temperature decreases to 65° F., then integrated thermostat 100 will cease operation of the various controlled fans to stop bringing in the cool outside fresh air, thereby preventing the indoor air temperature from decreasing below the 65° F. set point.

Some embodiments of the integrated thermostat 100 may manage heating events, cooling events and/or fresh air cooling events based on a plurality of temperature set points only. Such embodiments do not employ heating periods, cooling periods and/or fresh air cooling periods. Rather, initiation of a heating event occurs when the indoor air temperature falls below a predefined minimum temperature set point such that one or more air conditioning devices or units are operated to generate heated air. Termination of a heating event occurs when the indoor air temperature rises above the predefined minimum temperature set point after the generated heated air is delivered into the indoor area of the building. Conversely, cooling events and/or fresh air cooling events are initiated when the indoor air temperature rises above a predefined maximum temperature set point. Cooling events and/or fresh air cooling events terminate after the indoor air temperature falls below the predefined maximum temperature set point after the generated cool air and/or fresh air is delivered into the indoor area of the building. All such modifications and variations are intended to be included herein within the scope of this disclosure and to be protected by the accompanying claims.

Some embodiments of the integrated thermostat 100 employ different types of schedule time periods (interchangeably referred to herein as "control periods"). For example, an "away" period of time (a non-limiting example of a schedule time period) corresponding to times that the resident is expected to be away from the building may be predefined. Here, all air conditioning functions may be disabled or limited. An "at home" period may be defined wherein the resident is expected to occupy the residence. During the at home period, a first plurality of temperature set points may be used to control the available air conditioning devices or units to heat or cool the indoor air temperature. A "sleep" period may be used to define times when the resident is assumed to be sleeping. During the sleep period, a different second plurality of temperature set points may be used to control the available air conditioning devices or units to heat or cool the indoor air temperature. For example, the maximum temperature set point for a sleep period may be less than the maximum temperature set point for the at home period. All such modifications and variations are intended to be included herein within the scope of this disclosure and to be protected by the accompanying claims.

It is appreciated that various embodiments of the integrated thermostat 100 may be deployed in a variety of commercially available thermostats. Such commercially available thermostats (modified to become a special purpose computing device of an integrated thermostat 100) may use different nomenclature commands to control that particular thermostat. The user intuitively understands the meaning and effect of these different nomenclature commands. For example, a "set point temperature" may be understood by the user to be a temperature setting for any given time period. A "comfort set point temperature" may be understood by the user to be a temperature setting for a time period during which the building is expected to be occupied. A "comfort time" may be understood by the user to be a time period during which the conditioned space within the building is expected to be occupied. An "energy-saving set point temperature" may be understood by the user to be a set point temperature for an energy-saving period that may be defined for heating and/or cooling periods. A "setback temperature" is a set point temperature for an energy-saving period during a heating season and a "set-up" temperature may be a set point temperature for a cooling season. "Events" may be predefined times or time periods associated with a user activity, such as "wake" when the user is expected to rise in the morning, "leave" when the user is expected to leave the building, "return" when the user is expected to return to the building, "sleep" when the user is expected to go to sleep while in the building, and "vacation" when the user is expected to be away from the building for an extended period of time. "Cycle rates" may define the number of times a heating or cooling air conditioning device operates during any given hour. Embodiments of the integrated thermostat 100 may be configured to integrate with the particular controlling nomenclature commands used by a variety of different thermostats. All such different nomenclature commands are intended to be within the scope of this disclosure and to be protected by the accompanying claims.

Returning to FIG. 1, embodiments of the integrated thermostat 100 comprise a thermostat controller 102, an optional Bluetooth/Wi-Fi transceiver 104, an optional cellular transceiver 106, an outdoor temperature sensor interface 108, an optional user interface 110, an indoor temperature (and humidity) sensor 112, an optional physical wire interfaces 114 for remotely controlling one or more devices, a plurality of wire connection points 116, an optional touch-sensitive screen display 118, and a memory 120. Memory 120 includes regions for storing fresh air cooling logic 122, air conditioning control logic 124 (interchangeably referred to herein as HVAC control logic 124), user interface control logic 126, touch-sensitive display control logic 128, remote device physical wire control logic 130, transceiver communication logic 132, and set point data 134. The memory 120 may be any suitable memory device or system. Depending upon the embodiment, the memory 120 may be a dedicated memory system, a part of another component or system, and/or a distributed memory system. The memory 120 may also include other logic, modules and/or databases not illustrated or described herein. The logic 122, 124, 126, 128, 130, and/or 132 may be integrated together and/or may be integrated with other logic.

When logic residing in memory 120 is implemented as software and is stored in memory 120, one skilled in the art will appreciate that such logic can be stored on any computer-readable medium for use by or in connection with any computer and/or processor-related system or method. In the context of this disclosure, a memory 120 is a computer-readable medium that is an electronic, magnetic, optical, or other physical device or means that contains or stores a computer and/or processor program. The logic can be embodied in any computer-readable medium for use by or in connection with an instruction execution system, apparatus, or device, such as a computer-based system, processor-containing system, or other system that can fetch the instructions from the instruction execution system, apparatus, or device and execute the instructions associated with any logic. In the context of this disclosure, a "computer-readable medium" can be any means that can store, communicate, propagate, or transport the program associated with the logic for use by or in connection with the instruction execution system, apparatus, and/or device. The computer-readable medium can be, for example, but is not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette (magnetic, compact flash card, secure digital, or the like), a random access memory (RAM), a solid-state memory, a read-only memory (ROM), an erasable programmable read-only memory (EPROM, EEPROM, or Flash memory), an optical fiber, and a portable compact disc read-only memory (CDROM). Note that the computer-readable medium, could even be paper or another suitable medium upon which the program associated with logic is printed, as the program can be electronically captured, via for instance optical scanning of the paper or other medium, then compiled, interpreted, or otherwise processed in a suitable manner, if necessary, and then stored in memory 120.

The thermostat controller 102 retrieves and executes the various logic stored in memory 120 to control the operation of the integrated thermostat 100 and the connected air conditioning devices, based on the set point data 134 and other received data, such as outdoor air temperature information (acquired by a remote thermometer via the wireless or wire-based outdoor temperature sensor interface 108) and/or indoor air temperature information (acquired by the temperature sensor 112). The thermostat controller 102 may be any suitable processor or processing device. The thermostat controller 102 may be a commercially available processor. In other embodiments, the thermostat controller 102 may be a specially designed and fabricated processor, or may be part of a multi-purpose processing system, in accordance with embodiments of the integrated thermostat 100.

The Bluetooth/Wi-Fi transceiver 104 is configured to receive and transmit communications from various remote devices that are communicatively coupled to the integrated thermostat 100. In some embodiments, a plurality of different transceivers may be included depending upon the particular wireless communication format in use. For example, some embodiments may have a separate Bluetooth transceiver and a separate Wi-Fi transceiver. The integrated thermostat 100, executing the transceiver communication logic 132, generates and transmits suitable wireless communication signals to various wireless devices and receives transmitted wireless communication signals from the various wireless devices.

In some embodiments, an optional cellular transceiver 106 may be used to communicatively couple the integrated thermostat 100 to a cellular system. For example, some embodiments of the integrated thermostat 100 may be configured to transmit and receive cellular communications from a remote communication device, such as a user's mobile device (smartphone, etc.). The integrated thermostat 100, executing the transceiver communication logic 132, receives and transmits suitable wireless cellular communication signals from/to such remote wireless devices.

In some embodiments, an optional user interface 110 may be used to receive user input. For example, buttons, switches or the like may be provided for manual user input to control operation of the integrated thermostat 100. In the various embodiments, the thermostat controller 102, executing the user interface control logic 126, may interpret the received user input provided via the user interface 110.

Alternatively, or additionally, some embodiments may employ a touch- sensitive display 118 to receive user input. In the various embodiments, the thermostat controller 102, executing the touch-sensitive display control logic 128, may interpret the received user input provided via the user interface 110. Also, various information may be generated by the thermostat controller 102 and may then be presented on the touch-sensitive display 118 to the user. For example, the user may specify various temperature set points that are then stored into the set point data 134. In the various embodiments, one or more graphical user interfaces may be presented on the touch-sensitive display 118 to inform the user of various control and status information, and/or to receive user input intended to control operation of the various air conditioning unit(s).

In some embodiments, the temperature sensor 112 provides temperature information corresponding to a currently detected temperature of the indoor air. Additionally, in some embodiments sensor 112 may detect the current humidity level of the indoor air. The temperature information and/or humidity level information is communicated to the thermostat controller 102.

Some embodiments may include one or more remote device(s) physical wire interface(s) that controllably couple a remote device to the integrated thermostat 100 via a wire-based conductor. For example, a remote fan may be configured to operate based on control signals communicated over a wire conductor. Alternatively, a high voltage signal or a high state signal may activate (turn on) the remote fan. A zero (or low) voltage or a low state signal may deactivate (turn off) the remote fan. In the various embodiments, the thermostat controller 102, executing the fresh air cooling logic 122, may control the output of the interface(s) 114 to provide the high/zero voltage or the high/low state signals to the remote fan.

Legacy building air conditioning units (such as an HVAC unit), are configured to provide heated and/or cooled air in accordance with control signals provided by a thermostat. Typically, the air conditioning unit(s) may be controllably coupled to the thermostat via wire-based conductors, using wire connection terminals at the thermostat, which are connected between the thermostat and the air conditioning unit(s). Such wire-based connections are standardized across the industry so that different types of thermostats can universally control different types of air conditioning units. In the various embodiments of the integrated thermostat 100, these standardized wire connection terminals 116 are provided to controllably couple the integrated thermostat 100 to any available air conditioning units. The thermostat controller 102, executing the remote device(s) physical wire control logic 130, generates suitable control signals that are communicated to the various air conditioning units.

Alternatively, the integrated thermostat 100 may be controllably coupled to one or more available air conditioning units using a digital or analog wireless communication signal that is communicated from the thermostat controller 102 via one of the transceivers 104, 106. The integrated thermostat 100, executing the transceiver communication logic 132, generates suitable control signals that are wirelessly communicated to the controlled air conditioning unit(s). The integrated thermostat 100, executing the air conditioning control logic 124, generates and transmits suitable control signals to air conditioning unit(s) via the wire connection terminals 116.

Figure 2:
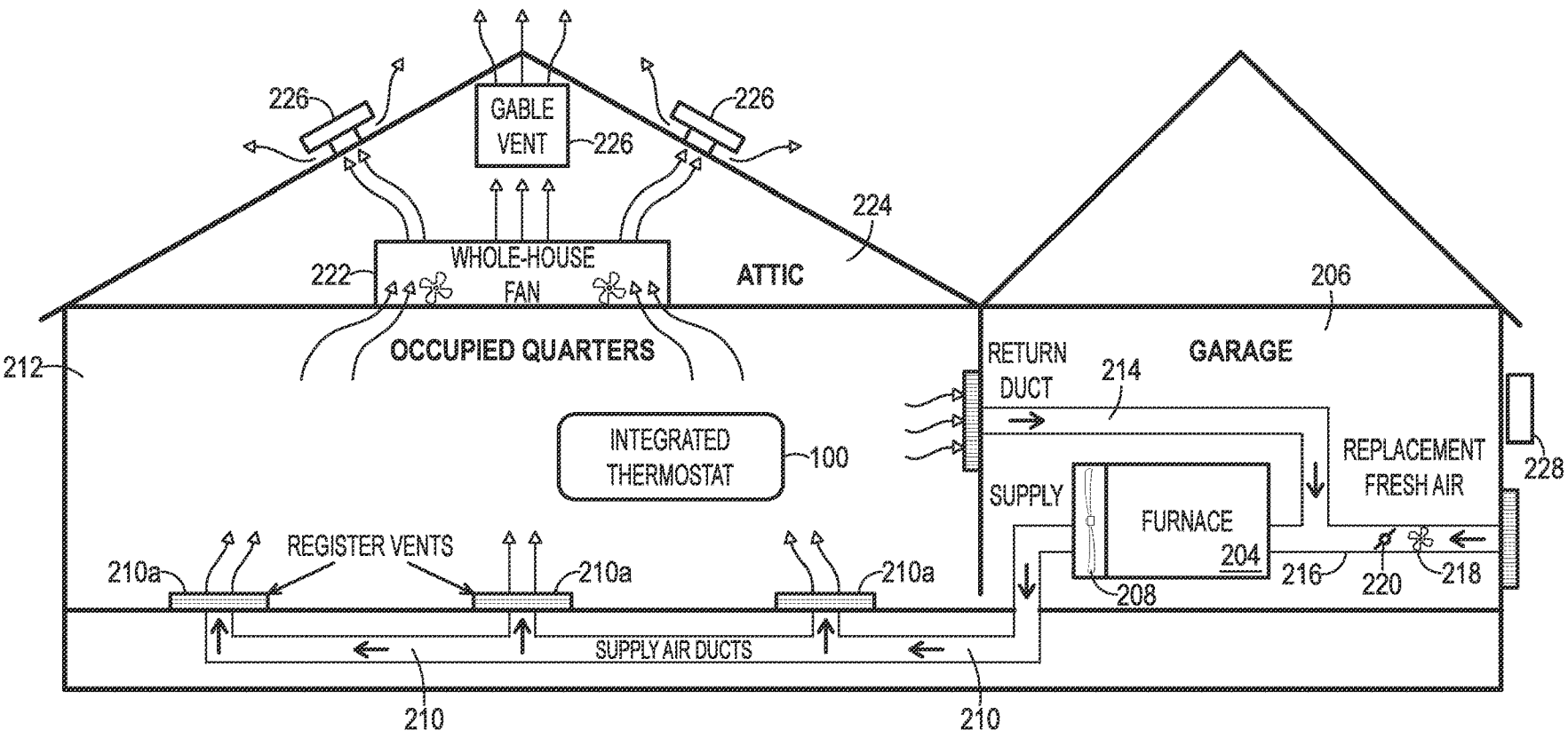
FIG. 2 is a conceptual diagram of a residence with an installed integrated thermostat.

FIG. 2 is a conceptual diagram of a non-limiting example residence 200 with an installed integrated thermostat 100. The installed integrated thermostat 100 is secured to a wall located within the interior of the residence 200 (interchangeably referred to herein as a building). The arrowed lines conceptually denote the directional flow of air through the residence 200, wherein the arrowhead indicates the direction of airflow.

During an interior space heating period, the integrated thermostat 100 generates a heating command that is communicated to the furnace 204. The remote furnace 204 (remote air conditioning unit) is conceptually illustrated as residing in the garage 206 and is remotely located from the integrated thermostat 100. Alternatively, the furnace 204 may reside in a remotely located furnace room (not shown) of the residence 200.

The furnace 204 (using natural gas, oil, solar power, or electricity) generates heated air within the furnace 204. The furnace fan 208 then operates to transport the heated air from the furnace 204 through the supply air ducts 210 that are ducted out to various regions of the residence 200. The heated air then exits out into the occupied quarters 212 of the residence 200 through register vents 210*a* that are fluidically coupled to the distal ends of the supply air ducts 210 to the occupied quarters 212. Air from the occupied quarters 212 is then transported back to the furnace 204, via one or more return ducts 214, for reheating. During the heating period, warmed air is continuously circulated between the furnace 204 and the occupied quarters 212 to maintain the temperature within the occupied quarters 212 at a temperature value that has been set at the thermostat controller system 200. (As defined herein, the heating function of a heat pump is referred to as the furnace 204.)

The furnace 204 receives external fresh air from time to time and/or in relatively small amounts. The replacement fresh air enters into the residence 200 via a fresh air duct 216. An optional fresh air intake fan 218 may be used to transport the fresh air into the fresh air duct 216. If fresh air is not needed, a damper 220 may be used to block the flow of fresh air through the fresh air duct 216. In some residences 200, the damper 220 may be controlled by a motor and control system to open and close to facilitate control of fresh intake air into the furnace 204.

Some residences 200 may include one or more whole-house exhaust fans 222 (interchangeably referred to herein as an attic fan 222) that, when operated, transports air from the occupied quarters 212 into the attic 224. The whole house fan(s) 222 can also be installed to exhaust hot air from the occupied quarters 212 directly outside of the home or building into the exterior air. The primary objective of the whole-house exhaust fan 222 is to evacuate hot indoor air out of the living quarters and pull cool air into the living quarters through open windows, open doors, the HVAC supply air ducts 210, and other non-airtight areas of the building. In addition to cooling the air within the occupied quarters 212, the thermal mass of the building structure 200 itself is cooled, which serves as a temperature storage element that continues to keep the occupied quarters 212 cool as external temperatures increase during the day. In some situations, the resident may choose to install one or more whole-house exhaust fans 222 so that an embodiment of the integrated thermostat 100 may be installed at their residence.

Typically, a whole-house exhaust fan 222 may be manually operated by the resident who manually actuates a manual fan control switch (not shown) and/or a touch-screen control button presented on the touch screen display 118. For example, the resident may intuitively understand that the temperature of the outside fresh air is cooler than the current indoor air within the occupied quarters 212, or they may want to ventilate the building with fresh air. The resident may decide to manually operate the whole-house exhaust fan 222 to draw out warm air from the occupied quarters 212 into the attic 224 (or directly to the outside environment). The air may then flow out of the attic 224 through roof vents 226 or gable vents 226. As air is transported out from the occupied quarters 212, the negative air pressure created by the operating whole-house exhaust fan 222 draws fresh air into the occupied quarters 212 from the external ambient environment. For example, the resident may manually open a door and/or window so that the cooler outside fresh air may enter from the outside environment into the occupied quarters 212.

In the illustrative application of an embodiment of the integrated thermostat 100 that has been installed in the residence 200, the integrated thermostat 100 is controllably coupled to the whole-house exhaust fan 222. The integrated thermostat 100 may communicate wireless or wire-based control signals to the whole-house exhaust fan 222.

Preferably, the integrated thermostat 100 is communicatively coupled to an outdoor temperature sensor 228 that senses ambient temperature (preferably in proximity to a fresh air intake exterior vent which feeds the fresh air duct 216) outside of the residence 200. Alternatively, or additionally, the sensor 228 may be configured to sense outdoor humidity and/or outdoor $CO_2$ levels. Also, the integrated thermostat 100 preferably receives information corresponding to the air temperature within the occupied quarters 212 from the thermostat controller system 200 or the optional temperature sensor 112 (FIG. 1).

Assuming that the resident has set the integrated thermostat 100 to a low- temperature setting during the nighttime or morning periods (a non-limiting exemplary fresh air cooling period), the thermostat controller 102 continuously compares the outside air temperature with the specified cool temperature setting and/or with the inside air temperature. When the temperature of the outside air is less than the indoor air temperature, preferably by some predefined offset, the thermostat controller 102 generates an actuation signal that is configured to turn on (activate) the whole-house exhaust fan 222. Alternatively, or additionally, when the temperature of the outside air is less than the cool temperature setting (interchangeably referred to herein as a cooling set point), preferably by some predefined offset, the thermostat controller 102 generates an actuation signal that is configured to turn on (activate) the whole-house exhaust fan 222. The actuation signal may be wirelessly transmitted to the whole-house exhaust fan 222, via the transceiver 104, or may be transmitted by a wire-based signal (when a conductor is used to controllably couple the thermostat controller 102 to the whole-house exhaust fan 222).

As the cooler air from outside is drawn into the occupied quarters 212, the current indoor air temperature within the occupied quarters 212 decreases. In an example embodiment, when the current indoor air temperature decreases to the outside air temperature, preferably within some predefined temperature offset, the thermostat controller 102 generates a deactivation signal that is communicated to the whole-house exhaust fan 222. Alternatively, or additionally, when the current indoor air temperature decreases to the cooling set point temperature, or preferably within some predefined temperature offset, the thermostat controller 102 generates a deactivation signal that is communicated to the whole-house exhaust fan 222. In response to receiving the deactivation signal, the whole-house exhaust fan 222 turns off (deactivates).

In embodiments where an A/C system is being used to generate cooled air to control the temperature within the occupied quarters 212 of the residence 200, the integrated thermostat 100 may be configured to deactivate the A/C system while the whole-house exhaust fan 222 is operating to draw in the cooler outside fresh air. When the outside air temperature is greater than the current indoor air temperature (or alternatively a specified temperature setting), the integrated thermostat 100 may operate the A/C system to cool the air in the occupied quarters 212 while deactivating the whole-house exhaust fan 222. Here, the control A/C system signals generated by the thermostat controller 102 are passed through the integrated thermostat 100 to the A/C system.

Additionally, or alternatively, the thermostat controller 102 may be controllably coupled to the furnace fan 208 and/or the fresh air duct 216. The cooler temperature outside fresh air can then be drawn in through the fresh air duct 216, passed through the air-handling system of the furnace 204, and transported into the occupied quarters 212 via the supply air ducts 210. Here, the outside fresh air may be more evenly distributed throughout the various rooms of the residence 200 (in part by the increased negative air pressure created by the operation of the whole-house exhaust fan 222). If the damper 220 is controllable to be in an open or a closed position, the thermostat controller 102 may be controllably coupled to the damper 220, using wireless signals or a wire-based connector, so that the damper 220 can be opened to permit passage of the cool outside air into the fresh air duct 216.

Figure 3:
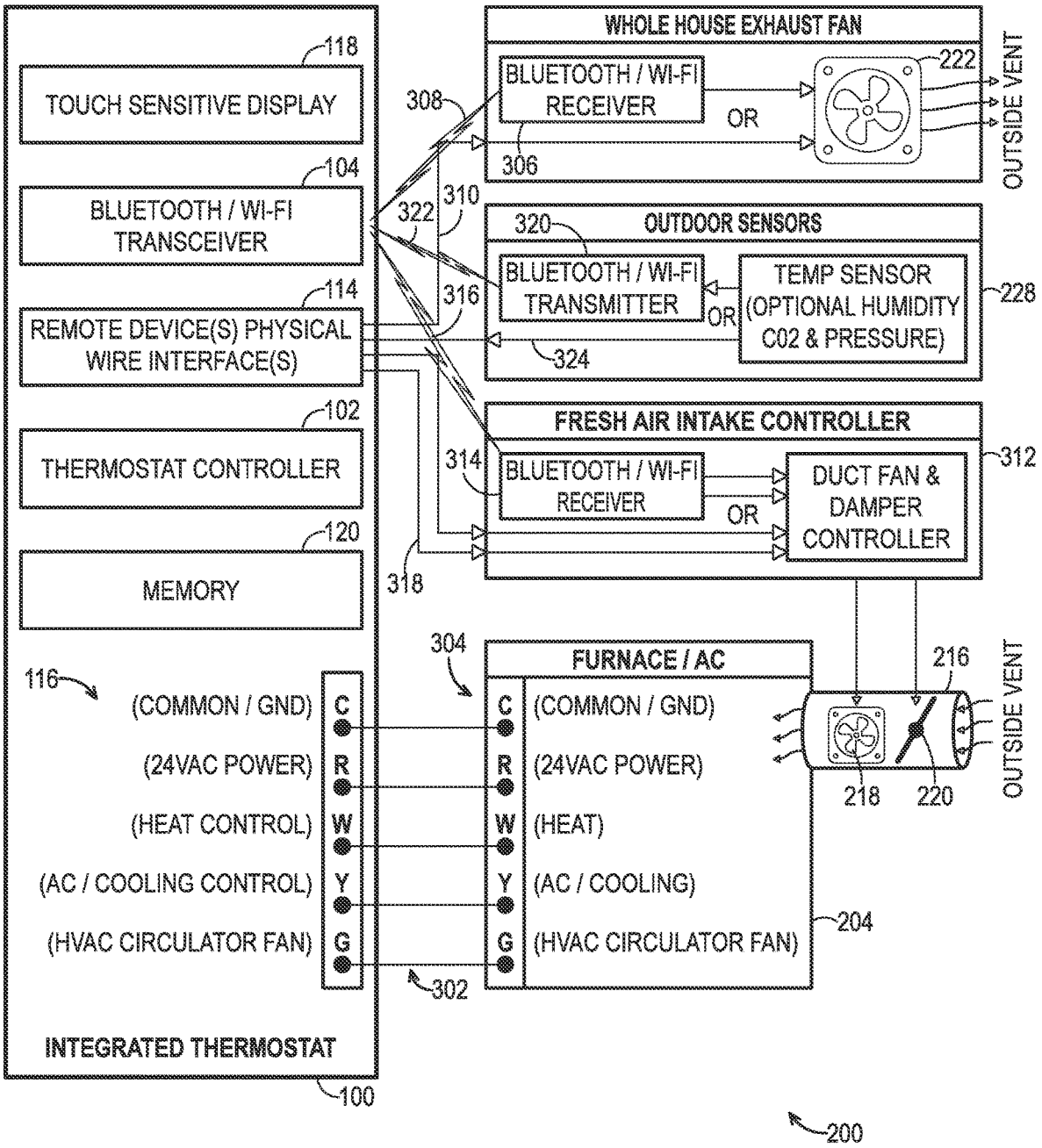
FIG. 3 is a block diagram of an integrated thermostat that is controllably coupled to a furnace/AC unit, a whole-house exhaust fan, a furnace fresh air intake fan, the duct, and an outside temperature sensor.

FIG. 3 is an electrical block diagram showing connections of a non-limiting example integrated thermostat 100 that is controllably coupled to the whole-house exhaust fan 222, the furnace fresh air intake fan 218, the damper 220, and an outdoor temperature sensor 228. The particular integrated thermostat 100 located at the residence 200 uses the wire-based terminal connections 116 (C, R, W, Y, and G) to controllably couple to the furnace 204 using wire connectors 302.

When the integrated thermostat 100 has been installed, the connections C, R, W, Y, and G of the terminal connections 116 are in electrical contact with the corresponding input connectors 304 of the furnace 204. Alternatively, some embodiments of the integrated thermostat 100 may be controllably coupled to the furnace 204 using a wireless communication signal system. Here, the transceiver 104 may be communicatively coupled to a transceiver (not shown) in the furnace 204.

In the various embodiments, wherein the integrated thermostat 100 includes a transceiver 104, the transceiver 104 of the integrated thermostat 100 may be communicatively coupled to and/or controllably coupled to the Bluetooth/Wi-Fi transceiver 306 of the whole house fan 222 via a wireless signal 308. Alternatively, a wire connector 310 that controllably couples the thermostat controller 102, via the interface 114, to the whole-house exhaust fan 222 may be used to control the operation of the whole-house exhaust fan 222.

As noted herein, the integrated thermostat 100 may be configured to controllably couple to other various air-handling devices, such as the fresh air intake fan 218 and/or the damper 220, which are controlled by a fresh air intake controller 312 that includes a wireless receiver 314, or is retrofitted with a wireless receiver 314. Accordingly, a wireless signal 316 communicated from the transceiver 104 may turn on (activate) or turn off (deactivate) the fresh air intake fan 218 and/or open/close the damper 220 to facilitate cooling of the residence 200 using the cool outside fresh air. Alternatively, operations of these components may be controlled by the wire connections 318 that controllably couples the thermostat controller 102, via the interface 114, to the fresh air intake fan 218 and/or the damper 220.

Preferably, the outdoor temperature sensor 228 includes a wireless transmitter 320 that communicatively couples the outdoor temperature sensor 228 with the thermostat controller 102. Here, a wireless signal 322 may communicate the sensed outdoor temperature to transceiver 104. Alternatively, a wire connection 324 that communicatively couples the thermostat controller 102, via the interface 114, to the outdoor temperature sensor 228 may be used to provide outdoor temperature information to the thermostat controller 102.

Figure 4:
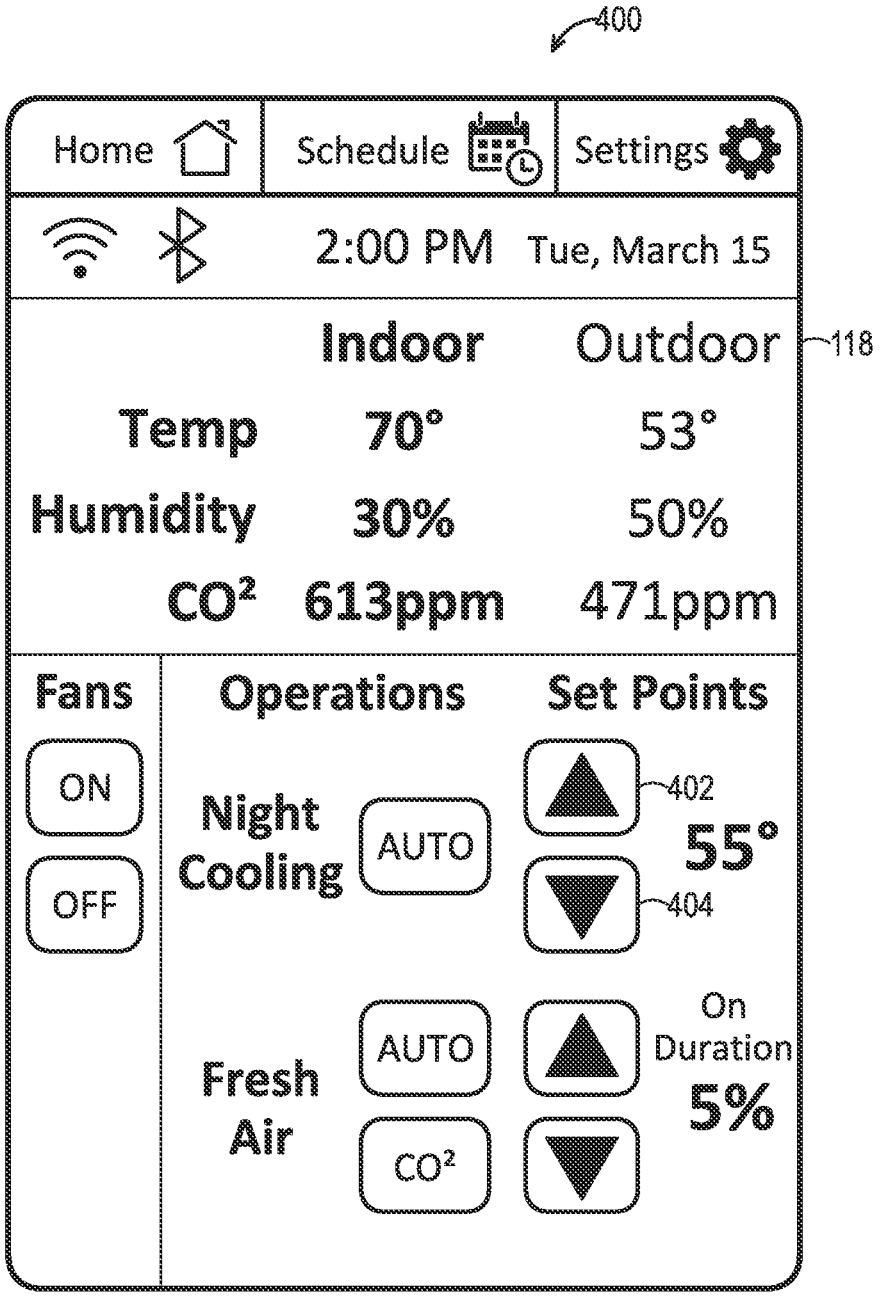
FIG. 4 is a conceptual illustration of a fresh air control GUI that is presented on the touch screen display of the integrated thermostat.

FIG. 4 is a conceptual illustration of a graphical user interface (GUI) 400 that is presented on the touch screen display 118 of the integrated thermostat 100. The GUI 400 pertains to fresh air operation. Other GUIs (not shown) may be used to show and/or control other operations. The presented information on the GUI 400 indicates current indoor conditions (70° temperature, 30% humidity, and $CO_2$ level of 413 PPM) and current outdoor condition (55° temperature, 50% humidity, and $CO_2$ level of 471 ppm).

The information presented on the touch screen display 118 further indicates that for night cooling, a 55° Fahrenheit (F) set point temperature has been specified by the resident. This 55° F. specification for a desired indoor temperature of 55° F. may have been made by the resident using the touch screen display 118 and/or using another electronic device, such as a smartphone, a computer interface, or the like. Information provided by the outdoor temperature sensor 228 indicates that the outdoor temperature is currently at 53° F., which is less than the indoor temperature of 70° F. Accordingly, the integrated thermostat 100 will operate as described herein to bring fresh cool outside air into the residence 200 until either the indoor temperature drops below the set point of 55° F. plus an optional predefined offset (3° F., for example), or until the current indoor air temperature decreases to the outdoor air temperature (optionally plus a predefined offset).

Touch-sensitive graphical icons may be presented on active regions (interchangeably referred to herein as a hot spot region) of the touch screen display 118 enabling the resident to make changes to the set points. For example, the resident may tap (touch with their finger) the graphical icon 402 to increase the temperature of the night cooling set point of 55° F. Alternatively, the resident may tap the graphical icon 404 to decrease the night cooling set point of 55° F.

Some embodiments of the integrated thermostat 100 may be configured to display connectivity to other devices and/or indicate the communication format (e.g., Wi-Fi, Bluetooth, etc.) using commonly understood graphical icons. Additionally, or alternatively, outdoor temperature, humidity, and/or CO2 levels, which are detected by the sensor 228 (FIG. 4), may be presented on the touch screen display 118. Additionally, or alternatively, the status of the remote fans that are controlled by the integrated thermostat 100 may be indicated on the touch screen display 118. Active regions on the touch screen display 118 may be provided to enable manual control of the fans by the resident for on-demand ventilation. Additionally, or alternatively, the operational status of the integrated thermostat 100 may be indicated. For example, but not limited to, the operational status of the integrated thermostat 100 to bring in fresh cool air may be indicated ("ON", "OFF", "AUTO"), and/or operational status to adjust $CO_2$ levels.

Some embodiments may be configured to provide a scheduling routine that enables the resident to control the operation of the integrated thermostat 100 on specific days and/or during specific hours. Some embodiments may present a current time, current day, and/or current date to facilitate use of the scheduling routine. The specified information may be saved into the set point data 134 (FIG. 1), for example.

Preferably, embodiments of the integrated thermostat 100 are configured to display the cooling set point (here, at 55° F.). Active regions may be included on the touch screen display 118, with intuitive graphical icons, which enable the resident to adjust the cooling set point upward or downward.

Additionally, or alternatively, some embodiments may be configured to display a set point for a ventilation duty cycle (5% on duration). This ventilation duty cycle number represents the percentage of time the remote fans are activated for fresh air ventilation when the integrated thermostat 100 is operating in the automatic mode. For example, a 5% set point for the ventilation duty cycle will run the fans for three minutes every hour. The ventilation duty cycle may be set by the resident, in an example embodiment, using the scheduling routine. Additionally, or alternatively, the touch screen display 118 may include active regions, with intuitive graphical icons, which enable the resident to adjust the set point of the ventilation duty cycle upward or downward.

As noted herein, some embodiments of the integrated thermostat 100 may not employ the optional touch screen display 118. In such embodiments, the integrated thermostat 100 may be configured to communicatively couple to a remote electronic device, such as a smartphone, a website, a computer interface, or the like. Some or all of the information illustrated in FIG. 4, or other supplemental information, may be presented on the touch screen display of the resident's remote electronic device, computer graphical interface with mouse-selectable controls, or web-based interface. When the remote electronic device is a smartphone, the transceiver 104 may be configured to communicatively couple to the smartphone using a Wi-Fi signal, a Bluetooth signal, a cellular signal, or another suitable wireless format. Here, the resident may be able to adjust the various set points of the integrated thermostat 100 using their smartphone.

Figure 5A:
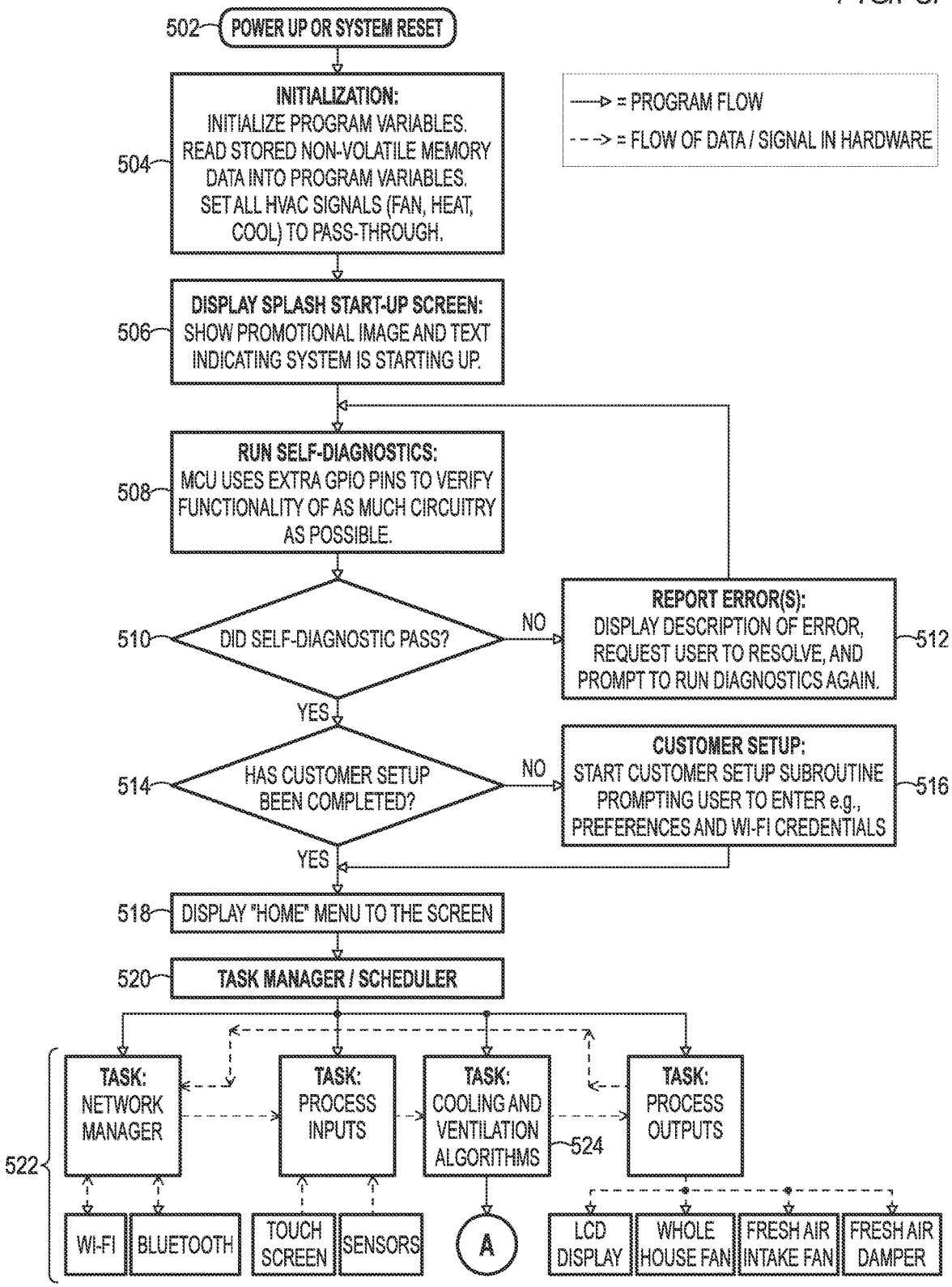
FIGS. 5A-5B represent a flow chart illustrating a non-limiting example operating process of an example embodiment of the integrated thermostat.
Figure 5B:
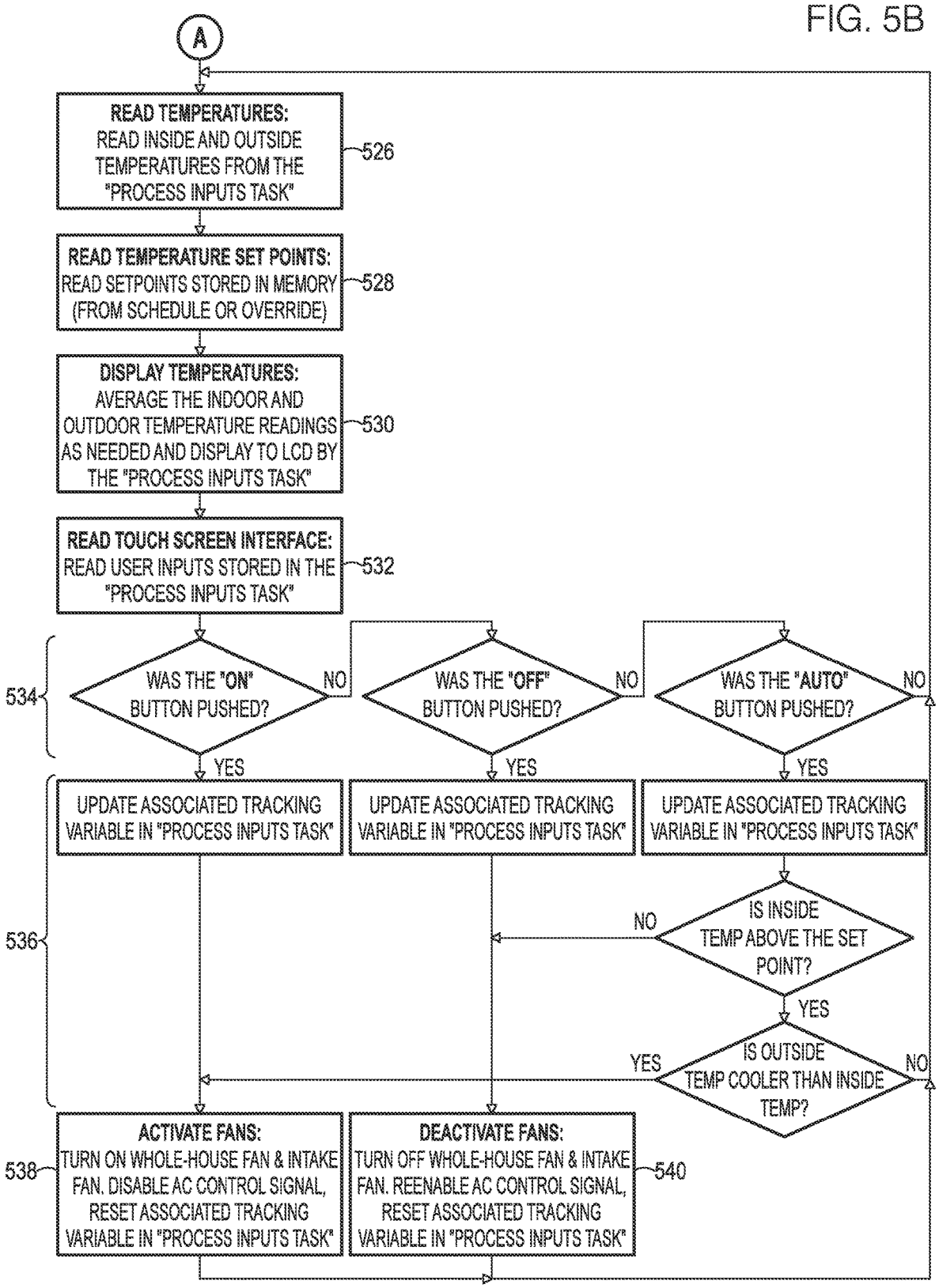

FIGS. 5A-5B represent a flow chart 500 illustrating an operating process of an example embodiment of the integrated thermostat 100. The flowchart 500 shows the architecture, functionality, and operation of a possible software implementation for realizing the operation of the integrated thermostat 100. In this regard, each block may represent a module, segment, or portion of code, which comprises one or more executable instructions for implementing the specified logical function(s). It should also be noted that in some alternative implementations, the functions noted in the blocks may occur out of the order noted in FIGS. 5A-5B, may include additional functions, and/or may omit some functions. For example, two blocks shown in succession in FIGS. 5A-5B may, in fact, be executed substantially concurrently, the blocks may sometimes be executed in the reverse order, or some of the blocks may not be executed in all instances, depending upon the functionality involved. All such modifications and variations are intended to be included herein within the scope of this disclosure and to be protected by the accompanying claims.

With respect to FIGS. 5A-5B, the process 500 starts at block 502, for example, in response to the starting, system reset, powering up of the system, or in response to a signal from a sensor or user interface. At block 504, the integrated thermostat 100 initializes. At block 506, a startup page may be optionally presented on the touch screen display 118.

At block 508, self-diagnostics are optionally run. At block 510, a determination is made whether the self-diagnostics passed. If not (the NO condition), the process proceeds to block 512, where report errors are presented on the touch screen display 118. Then, the process returns to block 508 to continue the self-diagnostics process after receiving corrective input. If a determination is made at block 510 that the self-diagnostics passed (the YES condition), the process proceeds to block 514.

At block 514, a determination is made whether the resident has completed the setup process. If not (the NO condition), the process proceeds to block 516, where prompts are presented on the touch screen display 118. Then, when the resident input is complete, the process moves to display the home menu at block 518. If a determination is made at block 514 that the setup process has been completed (the YES condition), the process proceeds to block 518.

At block 520, the task manager and scheduler routine are initiated. Blocks 522 indicate various tasks and scheduling that the resident may specify via the touch screen display 118. At block 524, the task manager and scheduler routines end, and the process continues to block 526 (FIG. 5B).

At block 526, inside and outside temperature information is read by the thermostat controller 102. At block 528, temperature set points are read. At block 530, the temperature information and the temperature set points 134 stored in memory 120, along with other supplemental information (see, for example, FIG. 4), are presented on the touch screen display 118. At block 532, any input by the resident, made via the touch screen display 118, is read and stored.

At blocks 534, a determination is made whether the resident has selected one of the "ON," "OFF," or "AUTO" operating conditions for control of the integrated thermostat 100. At blocks 536, updates to the process input tasks are saved based on the resident's selection at blocks 534. If the integrated thermostat 100 is to bring fresh, cool outside air into the residence 200, the various controlled fans are activated at block 538. If the fans are not to be operated to bring in the outside air, then the fans are deactivated at block 540. The process then returns to block 526.

Some embodiments of the integrated thermostat 100 may be configured to monitor the humidity of the air in the occupied quarters 212 and the outdoor air. If the resident has specified a humidity set point, such embodiments of the integrated thermostat 100 may be configured to bring in fresh outside air if the humidity of that air is at the specified humidity set point.

Similarly, some embodiments of the integrated thermostat 100 may be configured to monitor the $CO_2$ level of the air in the occupied quarters 212 and the outdoor air. If the resident has specified a $CO_2$ level set point, such embodiments of the integrated thermostat 100 may be configured to bring in fresh outside air if the $CO_2$ level of that air is above the specified $CO_2$ level set point (and/or by an optional predefined offset).

The thermostat controller 102 may be implemented as firmware or a combination of hardware and firmware. When implemented as hardware, thermostat controller 102 is constructed with commonly available components well known in the art. For example, but not limited to, thermostat controller 102 may be implemented as a suitable configuration of transistors on an integrated circuit (IC) chip. One skilled in the art of designing and implementing state machines will appreciate that many alternative configurations of the components (not shown) residing in an integrated thermostat 100 may be implemented having the above-described functionality and operation, and that such embodiments are too numerous to conveniently describe in detail herein. Any such implementation of the integrated thermostat 100 is intended to be within the scope of this disclosure and to be protected by the accompanying claims.

The integrated thermostat 100 has been described herein as being installed in a residence 200. Alternative embodiments may be configured to be installed in other types of structures. For example, embodiments of the integrated thermostat 100 may be configured to be installed in offices, apartments, or other buildings. As another non-limiting example, embodiments of the integrated thermostat 100 may be implemented in climate control agriculture buildings.

It should be emphasized that the above-described embodiments of the integrated thermostat 100 are merely possible examples of implementations of the invention. Many variations and modifications may be made to the above-described embodiments. All such modifications and variations are intended to be included herein within the scope of this disclosure and protected by the following claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions, and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non- obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

Therefore, having thus described the invention, at least the following is claimed:

1. An integrated thermostat, comprising:

a thermostat controller; and a memory that is communicatively coupled to the thermostat controller, wherein the memory stores:

air conditioning control logic that generates an air conditioning control signal during a heating event that controls an operation of an air conditioning unit that generates heated air that is fluidically communicated into an interior of a building; and fresh air cooling logic that generates a whole-house exhaust fan (WHF) control signal during a fresh air cooling event that controls an operation of a whole-house exhaust fan that fluidically transfers fresh air from an outdoor space that is exterior to the building into the interior of the building, wherein the integrated thermostat is communicatively coupled to an outdoor thermometer that detects an outdoor air temperature, and that communicates an outdoor air temperature information signal corresponding to the outdoor air temperature to the thermostat controller, wherein in response to the integrated thermostat operating during the heating event, the thermostat controller communicates the air conditioning control signal to the air conditioning unit to control the operation of the air conditioning unit to provide heated air into the interior of the building in response to an indoor air temperature being less than a heating set point stored in the memory, and wherein in response to the integrated thermostat operating during the fresh air cooling event, the integrated thermostat communicates the WHF control signal to the whole-house exhaust fan to control the operation of the whole-house exhaust fan to provide the fresh air into the interior of the building in response to the outdoor air temperature being less than a fresh air cooling set point stored in the memory.

2. The integrated thermostat of claim 1, wherein the fresh air cooling set point is equal to a cooling set point minus a predefined temperature offset, and wherein the fresh air cooling set point is specified by a user of the integrated thermostat system.

3. The integrated thermostat of claim 2, further comprising:

a user interface communicatively coupled to the thermostat controller, wherein the fresh air cooling set point is specified by the user via the user interface.

4. The integrated thermostat of claim 2, further comprising:

a user interface communicatively coupled to the thermostat controller, wherein the predefined temperature offset is specified by the user via the user interface.

5. The integrated thermostat of claim 1, wherein the integrated thermostat further comprises:

a thermostat that detects the indoor air temperature, wherein indoor air temperature information corresponding to the detected indoor air temperature is communicated to the thermostat controller, wherein, during the fresh air cooling event, the thermostat controller compares the indoor air temperature with the outdoor air temperature, and wherein the integrated thermostat communicates the WHF control signal to the whole-house exhaust fan to control the operation of the whole-house exhaust fan to provide the fresh air into the interior of the building in response to the outdoor air temperature being less than the indoor air temperature.

6. The integrated thermostat of claim 1, wherein an air conditioning period comprises a heating period and a cooling period, wherein times of a third period of the day that defines the cooling period encompasses the times of a second period of day that defines a fresh air cooling period, wherein the air conditioning unit is one of a heating and air conditioning (HVAC) unit or a heat pump that generates heated air or that generates cooled air, wherein the air conditioning control signal that controls the operation of the HVAC unit or the heat pump to generate the heated air is a first air conditioning control signal, and wherein in response to the integrated thermostat operating during the cooling period, the thermostat controller communicates a second air conditioning control signal to control an operation of the HVAC unit or the heat pump to provide the cooled air into the interior of the building in response to:

the indoor air temperature being greater than a cooling set point stored in the memory; and the outdoor air temperature being greater than the indoor air temperature.

7. The integrated thermostat of claim 6, wherein in response to the integrated thermostat operating during the fresh air cooling period and in response to the outdoor air temperature being less than the indoor air temperature, the thermostat controller disables operation of the HVAC unit or the heat pump, and wherein in response to the outdoor air temperature being less than the indoor air temperature, the thermostat controller communicates the WHF control signal to the whole-house exhaust fan to control the operation of the whole-house exhaust fan to provide the fresh air into the interior of the building.

8. The integrated thermostat of claim 6, wherein, during the fresh air cooling period and in response to the outdoor air temperature being less than the indoor air temperature, the thermostat controller:

disables operation of the HVAC unit or the heat pump;

communicates the WHF control signal to the whole-house exhaust fan to control the operation of the whole-house exhaust fan to provide the fresh air into the interior of the building;

compares a current indoor air temperature to the outdoor air temperature, wherein the WHF control signal is changed to halt operation of the whole-house exhaust fan when the current indoor air temperature becomes the same as the outdoor air temperature, and wherein the thermostat controller communicates the second air conditioning control signal to restart operation of the HVAC unit or the heat pump to generate the cooled air after the WHF control signal is changed to halt operation of the whole-house exhaust fan.

9. The integrated thermostat of claim 1, further comprising:

a transceiver communicatively coupled to the thermostat controller, wherein the transceiver is configured to communicatively couple to a wireless receiver that controls the operation of the whole-house exhaust fan, and wherein the whole-house exhaust fan operates in response to the wireless receiver receiving the WHF control signal communicated from the transceiver.

10. The integrated thermostat of claim 1, wherein the WHF control signal that controls the operation of the whole- house exhaust fan is a first WHF control signal, and wherein in response to the outdoor air temperature being less than the indoor temperature, and in response to the indoor temperature being greater than the fresh air cooling set point, the thermostat controller communicates a second WHF control signal to a remote fan to provide the fresh air into the interior of the building.

11. The integrated thermostat of claim 10, wherein the remote fan is a fresh air intake fan that provides the fresh air into the interior of the building via a supply air duct that transports air from the air conditioning unit into the interior of the building.

12. The integrated thermostat of claim 10, further comprising:

a transceiver communicatively coupled to the thermostat controller, wherein the transceiver is configured to communicatively couple to a wireless receiver that controls the operation of the remote fan, and wherein the remote fan operates in response to the wireless receiver receiving the second WHF control signal from the transceiver to bring the fresh air into the building.

13. The integrated thermostat of claim 1, further comprising:

a transceiver communicatively coupled to the thermostat controller, wherein the transceiver is configured to communicatively couple to a smartphone having a touch screen display, and wherein the fresh air cooling set point is specified by a user operating the touch screen display of the smartphone.

14. The integrated thermostat of claim 1, further comprising:

a transceiver communicatively coupled to the thermostat controller, wherein the transceiver is configured to communicatively couple to the outdoor thermometer, and wherein information corresponding to the outdoor air temperature is received at the transceiver in the integrated thermostat.

15. The integrated thermostat of claim 1, further comprising:

a transceiver communicatively coupled to the thermostat controller; and a sensor configured to sense a $CO_2$ level of air in the occupied quarters, wherein the transceiver is configured to communicatively couple to a sensor located outside of the building that is configured to sense the $CO_2$ level of the outdoor air, wherein information corresponding to the $CO_2$ level of the outdoor air is received at the transceiver in the integrated thermostat, and wherein the microcontroller operates the remote fan to draw the fresh air into the occupied quarters in response to the $CO_2$ level of the inside air being at least a $CO_2$ level set point, and the $CO_2$ level of the fresh air being at least less than the $CO_2$ level set point.

16. An integrated thermostat system, comprising:

an air conditioning unit that generates heated air that is fluidically communicated into an interior of a building;

a whole-house exhaust fan that fluidically transfers air in the interior of the building to an outside space that is exterior to the building;

an outdoor thermometer that detects an outdoor air temperature, wherein detected outdoor air temperature information corresponding to the outdoor air temperature is communicated to the thermostat controller; and an integrated thermostat controllably coupled to the air conditioning unit, controllably coupled to the whole-house exhaust fan, and communicatively coupled to the outdoor thermometer, comprising:

a thermostat controller; and a memory that is communicatively coupled to the thermostat controller, wherein the memory stores:

heating and air conditioning (HVAC) control logic that generates an HVAC control signal unit during a heating event that operates the HVAC unit to generate heated air that is fluidically communicated into the interior of the building; and integrated system temperature logic that generates a whole-house exhaust fan (WHF) control signal during a fresh air cooling event that operates the whole-house exhaust fan to fluidically transfer fresh air from an outdoor space that is exterior to the building into the interior of the building, wherein in response to the integrated thermostat operating during the heating event, the thermostat controller controls the operation of the air conditioning unit to provide heated air into the interior of the building in response to an indoor air temperature being less than a heating set point stored in the memory, and wherein in response to the integrated thermostat operating during the fresh air cooling event, the integrated thermostat controls the operation of the whole-house exhaust fan to provide fresh air into the interior of the building in response to the outdoor air temperature being less than the indoor air temperature, and in response to the indoor temperature being greater than a fresh air cooling set point stored in the memory.

17. The integrated thermostat system of claim 16, wherein the fresh air cooling set point is equal to a fresh air cooling set point minus a predefined temperature offset, and wherein the fresh air cooling set point is specified by a user of the integrated thermostat system.

18. The integrated thermostat system of claim 17, further comprising:

the user interface communicatively coupled to the thermostat controller, wherein the fresh air cooling set point is specified by the user via the user interface.

19. The integrated thermostat system of claim 18, further comprising:

the user interface communicatively coupled to the thermostat controller, wherein the predefined temperature offset is specified by the user via the user interface.

20. The integrated thermostat system of claim 16, wherein the integrated thermostat further comprises:

a thermostat that detects the indoor air temperature, wherein, during the fresh air cooling event, the thermostat controller compares the indoor air temperature with the outdoor air temperature, and wherein the integrated thermostat communicates the WHF control signal to the whole-house exhaust fan to control the operation of the whole-house exhaust fan to provide the fresh air into the interior of the building in response to the outdoor air temperature being less than the indoor air temperature.

21. The integrated thermostat system of claim 20, wherein in response to the integrated thermostat operating during the fresh air cooling event, the thermostat controller controls the operation of the air conditioning unit to provide cooled air into the interior of the building in response to:

the indoor air temperature being greater than the fresh air cooling set point, and the outdoor air temperature being greater than a current indoor air temperature.

* * * * *